United States Patent [19]

Takanashi et al.

[11] 4,184,100

[45] Jan. 15, 1980

[54] INDIRECTLY-HEATED CATHODE DEVICE FOR ELECTRON TUBES

[75] Inventors: Yukio Takanashi, Hiratsuka; Sakae Kimura, Tokyo; Takashi Kuse, Yokohama; Toshiharu Matsuki, Kawasaki, all of Japan

[73] Assignee: Tokyo Shibaura Electric Co., Ltd., Kawasaki, Japan

[21] Appl. No.: 888,993

[22] Filed: Mar. 22, 1978

[30] Foreign Application Priority Data

| | | | |
|---|---|---|---|
| Mar. 29, 1977 | [JP] | Japan | 52-33966 |
| Mar. 29, 1977 | [JP] | Japan | 52-33967 |
| Aug. 11, 1977 | [JP] | Japan | 52-95579 |
| Aug. 11, 1977 | [JP] | Japan | 52-95580 |

[51] Int. Cl.[2] ..... H01J 1/20; H01J 11/14

[52] U.S. Cl. ..... 313/337; 313/270; 313/40; 313/41; 427/77; 252/518

[58] Field of Search ..... 313/337, 40, 41, 270; 427/77; 252/518

[56] References Cited

U.S. PATENT DOCUMENTS

| | | | |
|---|---|---|---|
| 3,958,146 | 5/1976 | Buescher et al. | 313/337 |

FOREIGN PATENT DOCUMENTS

| | | | |
|---|---|---|---|
| 1104621 | 4/1961 | Fed. Rep. of Germany | 313/337 |
| 2656167 | 6/1977 | Fed. Rep. of Germany | 313/41 |
| 749256 | 5/1956 | United Kingdom | 313/346 |

*Primary Examiner*—Saxfield Chatmon, Jr.
*Attorney, Agent, or Firm*—Cushman, Darby & Cushman

[57] ABSTRACT

An indirectly-heated cathode device for electron tubes, comprising a hollow cathode sleeve of thin wall, a base metal mounted to one end of the sleeve and having the surface coated with an electron-emitting material, and a heater mounted within the sleeve. The sleeve is made of Ni-Cr alloy containing 2 to 35% by weight of Cr and predetermined amounts of additives including Co, W, Mo and/or Fe.

15 Claims, 7 Drawing Figures

INDIRECTLY-HEATED CATHODE DEVICE FOR ELECTRON TUBES

This invention relates to an indirectly-heated cathode device for electron tubes and more particularly to a quick-heating type cathode device for cathode ray tubes.

In a television receiver, it is desired that a picture image appear on the fluorescent screen as soon as switched on and be stabilized promptly. Conventional television receivers meeting this requirement include instant-on receivers in which the heater of the cathode ray tube is heated with half power when the receiver is off. However, many difficulties remain unsolved in instant-on receivers of this type. Recently, a quick-heating type cathode has come to be used in an attempt to overcome the difficulties inherent in conventional receivers.

Appended FIG. 1 is a side view, partly broken away, of a color cathode ray tube using a quick-heating type cathode and shows the portion comprising the in-line gun assembly. It is seen that a plate-like first electrode 1 is supported by a strap 2. A cathode device 3 comprises a hollow cathode sleeve 4 and a cathode base metal 5 having an electron-emitting material layer 6 on the surface thereof and is supported by a supporting cylinder 7 via three support members 8. The base metal 5 is forced into and welded to the top portion of the cathode sleeve 4. The supporting cylinder 7 is inserted into a cathode support 9 held by a strap 10 and is welded to the inner wall surface of the support 9 in a manner to provide a predetermined clearance between the first electrode 1 and the top of the cathode device 3.

As shown in the drawing, a heater 14 for heating the cathode sleeve 4 is disposed within the cathode sleeve 4 and is supported by a support plate 13 which is fixed to a strap 11. The straps 2, 10 and 11 are partially embedded in and, thus, fixed to an electrode-supporting column 12 of, for example, powder glass. Further, the support plate 13, after supporting the heater 14, is partly cut away as shown by a reference numeral 15. The assembly of the above-described construction is mounted on a stem 16.

The cathode sleeve of the cathode device 3 used in the conventional gun assembly of FIG. 1 is made of Nichrome (trade name), Cr(20wt.%)-Ni(80wt.%) alloy, commonly on the market. In order to increase the heat radiation efficiency, the cathode sleeve is heated within a wet hydrogen furnace thereby oxidized and, thus, the surface region thereof is blackened to achieve an increased heat radiation under an ordinary operating temperature. In operation, such a large amount of electric power as to compensate for the increased heat radiation is applied to the heater to quickly heat up the cathode. For example, the required power consumption per unit volume of the cathode is about 4 times as much as that for the conventional instant-on receiver.

The conventional sleeve of Nichrome alloy tends to be deformed if rapid heating and cooling are applied thereto repeatedly. If the sleeve wall is thickened, it may be possible to suppress the deformation. However, the heat capacity of the cathode device is increased if the sleeve wall is thickened, resulting in that it takes a longer time after switching-on for a picture image to appear on the fluorescent screen.

An object of this invention is to provide an indirectly-heated cathode device for electron tubes, which is small in heat capacity and free from deformation of the cathode sleeve.

Another object is to provide an indirectly-heated cathode device which, when used in a cathode ray tube, permits a picture image to appear on the fluorescent screen in a short time.

These and other objects which will be apparent from the following description have been achieved according to this invention by an indirectly-heated cathode device for electron tubes, comprising a hollow cathode sleeve having a thin wall; a base metal having a layer of electron-emitting materials on the surface thereof and provided at one end of the sleeve; and a heater disposed within the sleeve for heating the sleeve, the sleeve being formed of an alloy consisting essentially of 2 to 35% by weight of chromium, an additive metal selected from the group consisting of cobalt, tungsten, molybdenum, iron and any mixtures thereof, and the balance of nickel, the cobalt content when present ranging from 3 to 30% by weight, the tungsten content when present ranging from 0.5 to 15% by weight, the molybdenum content when present ranging from 0.5 to 15% by weight and the iron content when present ranging from 0.5 to 15% by weight.

For the purposes of this invention, the surface region of the cathode sleeve may not be blackened by oxidation. But, in order to improve the heat radiation property of the cathode sleeve, the blackening may be carried out by the method described later.

This invention will be more fully understood from the following detailed description when taken in conjunction with the appended drawings, in which.

Figure 1:
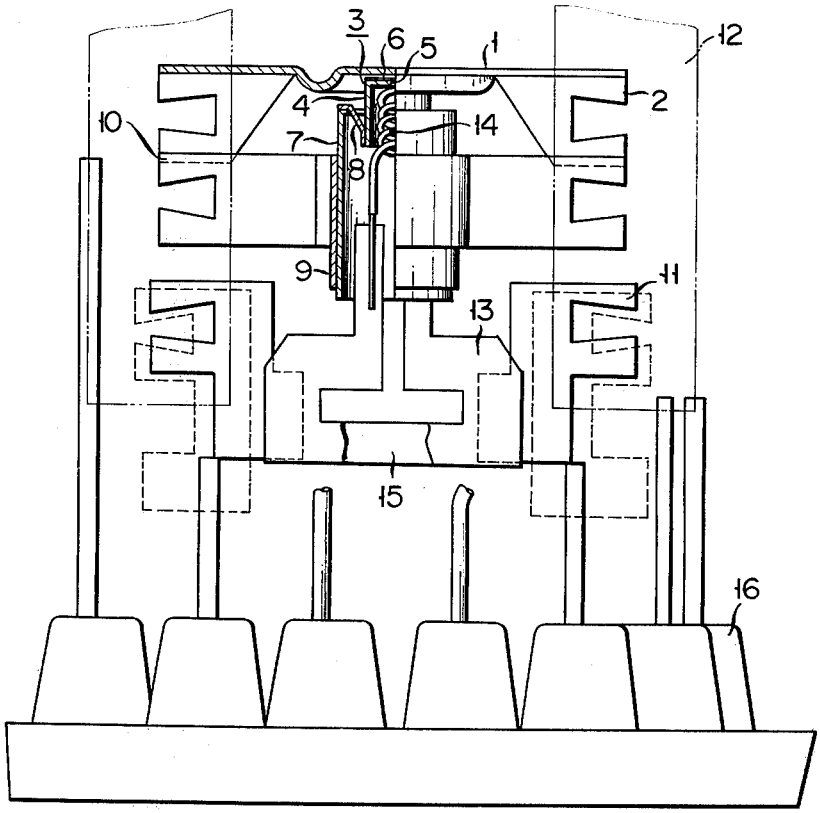
FIG. 1 is a side view, partly broken away, of an electron gun assembly using an indirectly-heated cathode device.

This invention is based on the finding that an Ni-Cr alloy having a predetermined range of Cr content and containing a certain additive of metal is free from deformation when subjected to heating and cooling repeatedly and, thus, exhibits prominent properties when used as a material of cathode sleeve.

As described previously, the alloy forming the cathode sleeve of an indirectly-heated cathode device of the present invention consists essentially of nickel, chromium and an additive metal selected from the group consisting of cobalt, tungsten, molybdenum, iron and mixtures thereof. The chromium content of the alloy should fall within the range of from 2 to 35% by weight. If the chromium content exceeds 35% by weight, the resultant alloy is unsatisfactory in workability, particularly, hot workability. On the other hand, the chromium content lower than 2% by weight brings about difficulties in the oxidation step described later. Specifically, in preferred embodiments of this invention, the cathode sleeve of the cathode device is subjected to oxidation for forming a black oxide layer on the surface so as to enable the cathode device to perform its function very rapidly. If the chromium content is less than 2% by weight, it is impossible to obtain a uniform surface layer of black oxide. Preferably, the chromium content of the alloy ranges from 15 to 25% by weight.

The additive metal forms a solid solution with the Ni-Cr alloy, serves to suppress the growth of crystal grains in the heating step, and reinforces the alloy without impairing the electric properties of the Ni-Cr alloy. Where cobalt is the additive metal, the content thereof should be 3 to 30% by weight. If the cobalt content exceeds 30% by weight, the resultant alloy is unsatisfactory in workability. On the other hand, the resultant alloy is not sufficiently reinforced if the cobalt content is lower than 2% by weight. Preferably, the cobalt content ranges from 10 to 20% by weight.

Where tungsten or molybdenum is the additive metal, the content thereof should be 0.5 to 15% by weight. If 15% by weight is exceeded, the resultant alloy is unsatisfactory in workability, with the additive content lower than 0.5% by weight leading to an unsatisfactory reinforcement of the resultant alloy. Preferably, the content of tungsten or molybdenum ranges from 3 to 10% by weight. Particularly, where the alloy is of four component system of Ni-Cr-W-Mo, it is preferred to specify the Cr content at 15 to 25% by weight, the W content at 3 to 10% by weight and the Mo content at 5 to 12% by weight, with the balance provided by Ni.

Where iron is the additive metal, the content thereof should be 0.5 to 15% by weight. If the iron content exceeds 15% by weight, the resultant alloy is unsatisfactory in workability, with the value lower than 0.5% by weight leading to an unsatisfactory reinforcement of the resultant alloy. Preferably, the iron content of the alloy should be 5 to 15% by weight.

A mixture of two or more of metals selected from the group of Co, W, Mo and Fe can be used. In this case, the amount of each component of the mixture should fall within the range specified above.

As described previously, the alloy used as the material of the cathode sleeve of this invention consists essentially of nickel, chromium and the particular additive metal. But, it is acceptable for the alloy to contain some other elements coming from, for example, the raw materials of the alloy, the working atmosphere, the deoxidizer or the agent for suppressing the growth of crystal grains. Typical examples of the elements of this kind include Mn, Si, C, Al, Ti and rare earth elements. The total amount of these elements should be no more than 3% by weight.

Described in the following are an indirectly-heated cathode device of this invention including a cathode sleeve of the particular alloy explained above and a method of producing the same, with reference to the appended FIGS. 2 and 3.

In these drawings, a reference numeral 21 denotes a hollow cylindrical cathode sleeve having a thin wall and made of the particular alloy described previously. The upper opening of the sleeve 21 is closed by a disk-like base metal 5. Specifically, the base metal 5 inserted into the upper portion of the sleeve 21 is pressed from both upper and lower sides so as to expand until its periphery is pressed against the inner surface of the cathode sleeve 21. Under this condition, welding is applied to the contact region of the base metal and the cathode sleeve.

Figure 3:
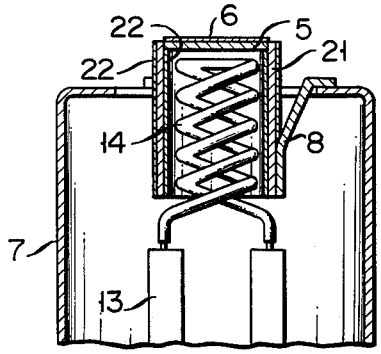
FIG. 3 is a cross sectional view along line III—III of FIG. 2.

Further, three plate-like support members 8 each made of Fe-Ni alloy are equidistantly welded to the lower portion of the outer surface of the cathode sleeve 21 as clearly seen from FIG. 3. Usually, the sleeve 21 provided with the support members 8 is heated at about 850° C. to about 1,100° C. for 10 minutes to one hour in a wet hydrogen atmosphere having a dew point of 5 to 40° C. By the heat treatment mentioned, chromium is selectively oxidized so as to form a black layer 22 consisting of chromium oxide alone on the wall surface of the sleeve 21.

Then, the upper surface of the base metal 5 is coated with an electron-emitting material 6. For example, a mixture of complex oxides prepared by heating a mixture of $BaCO_3$ (57 wt.%), $SrCO_3$ (39 wt.%) and $CaCO_3$ (4 wt.%) is used as the electron-emitting material 6. Finally, the cathode sleeve 21 is supported by a supporting cylinder 7 and a heater 14 supported by a support plate 13 is disposed within the cathode sleeve 21 as is the case with the conventional method.

As described previously, the cathode sleeve of this invention is made of an Ni-Cr alloy containing an additive metal of Co, W, Mo and/or Fe. The cathode sleeve made of this particular alloy is prominently superior in mechanical properties to the conventional cathode sleeve made of an alloy of Ni-Cr alone. For example, various samples were subjected to tensile strength tests under high temperatures, obtaining the results as shown in Table 1.

Table 1

| Sample | Sleeve Material Composition (wt.%) | Tensile Strength Under 800° C. ($Kg/mm^2$) | Tensile Strength Under 900° C. ($Kg/mm^2$) |
|---|---|---|---|
| 1 (conventional) | Ni-20Cr | 14.6 | 8.0 |
| 2 | Ni-20Cr-4W | 19.8 | 13.8 |
| 3 | Ni-20Cr-9W | 21.2 | 14.1 |
| 4 | Ni-20Cr-6Mo | 18.0 | 12.1 |
| 5 | Ni-20Cr-9.5Mo | 19.9 | 12.8 |
| 6 | Ni-20.1Cr-4W-11.7Mo | 21.3 | 19.7 |
| 7 | Ni-19.9Cr-7W-8.6Mo | 23.4 | 19.8 |
| 8 | Ni-20Cr-15Co | 16.8 | 11.6 |
| 9 | Ni-20Cr-20Co | 17.9 | 12.1 |
| 10 | Ni-29.4Cr-5.1Co | 22.8 | 17.9 |
| 11 | Ni-15Cr-26.3Co | 17.2 | 13.1 |
| 12 | Ni-19.5Cr-3Fe | 16.2 | 11.3 |
| 13 | Ni-19.1Cr-9Fe | 17.7 | 11.5 |
| 14 | Ni-20.1Cr-14.0Co-12.7Fe | 21.3 | 18.9 |
| 15 | Ni-19Cr-12.0Co-13.6Fe | 22.4 | 19.6 |
| 16 | Ni-20.1Cr-12.7Co-4W | 22.8 | 17.8 |
| 17 | Ni-19.9Cr-12.6Co-7W | 23.4 | 17.9 |
| 18 | Ni-20.1Cr-14.0Co-11.7Mo | 21.3 | 19.7 |
| 19 | Ni-19.9Cr-17.0Co-8.6Mo | 23.2 | 19.8 |
| 20 | Ni-20.1Cr-10.7Co-4W-11.7Mo | 23.3 | 21.7 |
| 21 | Ni-19.9Cr-17.6Co-7W-8.6Mo | 28.4 | 20.8 |

Table 1 suggests that the alloy of this invention exhibits a tensile strength about 1.5 to about 2 times as high as that of the conventional Ni-Cr alloy under about 850° C. at which the cathode operates. The high mechanical strength of the alloy renders it possible to form the cathode sleeve having a thin wall. More accurately, the cathode sleeve of this invention having a thin wall is free from deformation when subjected to repeated heating and cooling cycles. In addition, the cathode sleeve exhibits a good quick-heating property because the wall is thin and, thus, the heat capacity of the sleeve is sufficiently small.

It is also important to note that the cathode sleeve of this invention exhibits a relatively good anti-oxidation property and yet is provided with a uniform black layer formed by the heat treatment under a wet hydrogen atmosphere as described previously. For example, some of the sleeve samples listed in Table 1 were heated for 30 minutes at 1,050° C. under the atmosphere of wet hydrogen having a dew point of 25° C. so as to be examined about increased weights thereof by oxidation, obtaining the results as shown in Table 2.

Table 2

| Sample | Increased weight by oxidation (mg/mm$^2$) |
|---|---|
| 1(conventional) | 1.33 |
| 2 | 1.21 |
| 4 | 1.10 |
| 8 | 0.91 |
| 10 | 1.39 |
| 13 | 1.15 |

As shown in Table 2, the sample 10 exhibits an oxidation resistance lower than the conventional sample 1 because it contains a relatively large amount of chromium, but it has a good mechanical property as shown in Table 1, thus rendering it satisfactory as a whole to use it as a cathode sleeve.

Further, comparative tests were conducted in the following fashion for studying the deformation of the cathode sleeve of the cathode device. Specifically, a cathode device comprising a cathode sleeve made of an Ni-Cr alloy or of the particular alloy of this invention was incorporated into an ordinary electron gun assembly as shown in FIG. 1 and intermittently heated by the heater 14. Namely, the heater was kept switched on for 5 minutes, followed by switching-off for 10 minutes and in this fashion the heating-cooling cycle was repeatedly carried out. Incidentally, the change in clearance between the cathode sleeve and the first electrode 1 is proportional to the variation of cut-off voltage. Thus, the deformation of the cathode sleeve was determined by the variation of cut-off voltage. In these tests, the heating temperature was set at 950° C. because it takes a longer time under the ordinary operating temperature for the cathode sleeve deformation to be recognized.

Figure 4:
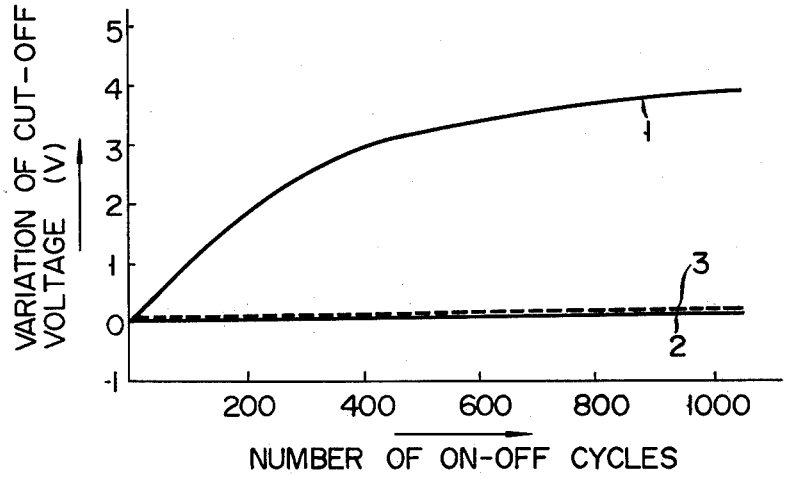
FIG. 4 is a graph showing properties of a cathode device according to the present invention in comparison with prior arts.

FIG. 4 shows the results of the comparative tests. Curve 1 of FIG. 4 denotes the case where the cathode sleeve was made of the conventional Ni-Cr alloy, curves 2 and 3 representing the cases of this invention. Namely, curve 2 relates to sample 16 shown in Table 1 and to cathode sleeves made of Ni-Cr alloys each containing the additive metal of W alone, W and Mo, or Co alone. On the other hand, curve 3 is concerned with sample 14 shown in Table 1 and to a cathode sleeve made of Cr-Mo-Ni alloy. FIG. 4 clearly shows that the conventional sleeve made of an Ni-Cr alloy begins to be deformed at the time when the on-off operation reaches about 100 times. In contrast, the cathode sleeve of this invention is substantially free from deformation over a long period of time. Although similar tests were conducted with the heating temperature elevated to 1,000° C., little deformation was recognized in the cathode sleeve of this invention.

Figure 2:
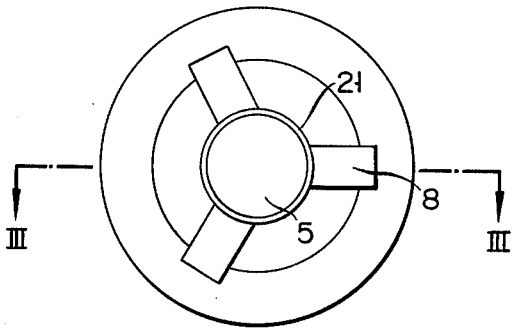
FIG. 2 is a plan view of a cathode device according to this invention.
Figure 5:
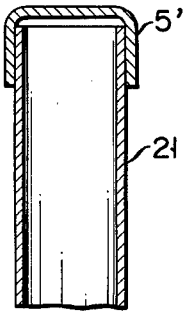
FIGS. 5 to 7 are cross sectional views of cathode devices according to the embodiments of this invention.
Figure 6:
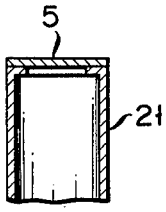
Figure 7:
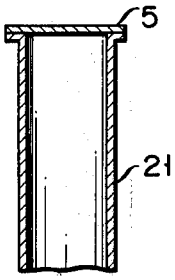

In the embodiment of FIGS. 2 and 3, the base metal 5 is inserted into the upper portion of the sleeve 21. Alternatively, a cup-like base metal 5' may be mounted in a manner to house the upper portion of the sleeve 21 as shown in FIG. 5. Further, it is possible to fold inward or outward the upper edge portion of the sleeve 21 and weld the base metal 5 to the folded portion as shown in FIG. 6 or 7.

What we claim is:

1. An indirectly-heated cathode device for electron tubes comprising a hollow cathode sleeve having a thin wall; a base metal having a layer of electron-emitting materials formed on the surface thereof and provided at one end of the sleeve; and a heater disposed within the sleeve for heating the sleeve, the sleeve being made of an alloy consisting essentially of 2 to 35% by weight of chromium, an additive metal selected from the group consisting of cobalt, tungsten, molybdenum, and mixtures thereof, and the balance of nickel, the cobalt content when present ranging from 3 to 30% by weight, the tungsten content when present ranging from 0.5 to 15% by weight, the molybdenum content when present ranging from 0.5 to 15% by weight.

2. The cathode device according to claim 1, wherein the chromium content ranges from 15 to 25% by weight.

3. The cathode device according to claim 1, wherein the additive metal is cobalt.

4. The cathode device according to claim 3, wherein the cobalt content ranges from 10 to 20% by weight.

5. The cathode device according to claim 1, wherein the additive metal is tungsten.

6. The cathode device according to claim 5, wherein the tungsten content ranges from 3 to 10% by weight.

7. The cathode device according to claim 1, wherein the additive metal is molybdenum.

8. The cathode device according to claim 7, wherein the molybdenum content ranges from 3 to 10% by weight.

9. The cathode device according to claim 1, wherein the alloy consists essentially of 15 to 25% by weight of chromium, 3 to 10% by weight of tungsten, 5 to 12% by weight of molybdenum and the balance of nickel.

10. The cathode device according to claim 1, wherein the cathode sleeve is covered with a black layer consisting essentially of chromium oxide.

11. The cathode device according to claim 10, wherein the black layer is formed by heating under a wet hydrogen atmosphere.

12. The cathode device according to claim 1, wherein the base metal is inserted in and welded to one edge portion of the cathode sleeve.

13. The cathode device according to claim 1, wherein the base metal is of a cup shape and houses one edge portion of the cathode sleeve.

14. The cathode device according to claim 1, wherein one edge portion of the cathode sleeve is folded inward and the base metal is supported by the folded portion.

15. The cathode sleeve according to claim 1, wherein one edge portion of the cathode sleeve is folded outward and the base metal is supported by the folded portion.

* * * * *